US006230096B1

(12) United States Patent
Nishimoto

(10) Patent No.: US 6,230,096 B1
(45) Date of Patent: May 8, 2001

(54) CYLINDER IDENTIFICATION APPARATUS FOR INTERNAL COMBUSTION ENGINE

(75) Inventor: Kouichi Nishimoto, Hyogo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/323,817

(22) Filed: Jun. 2, 1999

(30) Foreign Application Priority Data

Jan. 26, 1999 (JP) ..... 11-017496

(51) Int. Cl.[7] ..... F02D 45/00
(52) U.S. Cl. ..... 701/113; 701/114; 73/118.1
(58) Field of Search ..... 123/406.18, 476, 123/477, 479, 612, 613, 617; 73/118.1; 701/113, 114

(56) References Cited

U.S. PATENT DOCUMENTS 4,664,082 * 5/1987 Suzuki ..... 123/406.18

FOREIGN PATENT DOCUMENTS 5-296100 * 11/1993 (JP) .

* cited by examiner

*Primary Examiner*—Andrew M. Dolinar
(74) *Attorney, Agent, or Firm*—Sughrue, Mion, Zinn, Macpeak & Seas, PLLC

(57) ABSTRACT

A cylinder identification apparatus for an internal combustion engine is able to inhibit erroneous operations caused by noise. The cylinder identification apparatus includes a crank angle sensor for detecting a rotational position of a crankshaft of the internal combustion engine having a plurality of cylinders, a cylinder identifier for identifying the respective cylinders based on a signal output from the crank angle sensor, an engine controller for controlling the internal combustion engine based on the result of cylinder identification carried out by the cylinder identifier, and a noise determiner for determining, before operational processing is implemented based on a particular angle signal, whether the particular angle signal among output signals from the crank angle sensor includes noise so that it inhibits subsequent operation processing if there is noise included in the particular angle signal. When the noise determiner receives a present particular angle signal, it effects noise determination on all angle signals from the last particular angle signal to the present particular angle signal at the same time, and it also compares the present angle signal cycle with the last normal angle signal cycle whenever it effects noise determination.

5 Claims, 9 Drawing Sheets

PRIOR ART

CYLINDER IDENTIFICATION APPARATUS FOR INTERNAL COMBUSTION ENGINE

BACKGROUND OF THE INVENTION

1. Field of the Invention

The present invention relates to a cylinder identification apparatus for an internal combustion engine that is adapted to identify a cylinder in accordance with a signal output from a crank angle sensor and, more particularly, to a cylinder identification apparatus capable of determining whether a noise is on a signal output from the crank angle sensor.

2. Description of the Related Art

A signal in synchronization with the revolution of an engine is used to control the ignition timing, fuel injection, etc. of an internal combustion engine. A generator producing the signal usually detects the revolution of a camshaft or a crankshaft of the engine. An example of a crank angle sensor is shown in FIG. 4 and FIG. 5. A crank angle sensor, generally designated at reference numeral 8 in these figures, includes a rotary shaft 1, which rotates in synchronization with an engine (not shown), a rotary disc 2 which is mounted on the rotary shaft 1 and provided with a plurality of windows 3 at locations each corresponding to a desired detection angle or angular position of a corresponding cylinder, a light emitting diode 4*f* or emitting a beam of light, a photodiode 5 receiving the light emitted from the light emitting diode 4, an amplifier circuit 6 connected to the photodiode 5 for amplifying an output signal of the photodiode 5, and an output transistor 7 which is connected to the amplifier circuit 6 and has an open collector. A window 3' for identifying a particular cylinder is provided in the rotary disc 2 so that it is disposed in an asymmetric relation with respect to the windows 3 which identify other (non-particular) cylinders.

Thus, the crank angle sensor 8 outputs a signal illustrated in FIG. 6. The signal has a falling edge for a particular cylinder, namely, cylinder #1, which is offset 10 degrees toward a retarding side (ATDC 5 degrees or 5 degrees after top dead center) from those for the other cylinders, namely, cylinder #2, cylinder #3, and cylinder #4. The signal also has rising edges for all the cylinders at BTDC 75 degrees or 75 degrees before top dead center.

Referring now to FIG. 7 and FIG. 8, the way how to identify a particular cylinder will be described. As shown in FIG. 7, the output signal of the crank angle sensor 8 is supplied to a microcomputer 10 via an interface circuit 9. The microcomputer 10 identifies the particular cylinder according to a flowchart shown in FIG. 8. First, in step S1, a high-level output period t and its cycle (i.e., periods between successive rising edges) T of a signal waveform of the crank angle sensor signal shown in FIG. 6 are calculated, and the flow then proceeds to step S2 wherein a ratio t/T is calculated. Subsequently, in step S3, a mean threshold value $\alpha_n$ that gives $t_1/T>\alpha>t_0/T$ is provided, and $\alpha_n$ is determined according to the following operational expression:

$$\alpha_n=(1-k)\alpha_{n-1}+k(t/T)_n$$

where k=constant

The value of $\alpha_n$ calculated in step S3 is compared with the ratio t/T (step S4), and if it is found that $t/T-\alpha_n>0$, then it is decided that the cylinder is the particular cylinder and an identification flag is set (step S5). If it is found in step S4 that $t/T-\alpha_n<0$, then it is decided that the cylinder is a different cylinder.

FIG. 9 schematically illustrates an example of the crank angle sensor according to another prior art. A crank angle sensor 18 in the figure comprises a rotary magnetic member 18*a* which is mounted on a camshaft or the like that rotates in synchronization with at crankshaft of an engine, and the outer periphery of which is provided with teeth formed by a plurality of projections and recessions for detecting a crank angle; and a magnetic detector 18*b* which is disposed near the rotary magnetic member 18*a* such that it is opposed to the projections of the rotary magnetic member 18*a* to detect a change in the magnetic force caused by a change in the distance relative to the projections and recessions so as to detect positions of the projections and recessions, i.e., crank angles. The output signals of the magnetic detector 18*b* are supplied to the microcomputer 10.

FIG. 10A shows the output signals of the crank angle sensor 18 of FIG. 9 and the count values on a cylinder identification counter incorporated in the microcomputer 10; FIG. 10B shows the timing of interrupt processing, such as the processing for fuel injection and ignition control, controlled by a timer incorporated in the microcomputer 10; and FIG. 10C shows interrupt timing at which interrupts are made in synchronization with crank angle signals.

As is obvious from FIG. 9 and FIG. 10A, the teeth or projections of the teeth of the rotary magnetic member 18*a* are provided almost at every 10° of crank angle (10° CA), some being provided at 30° of crank angle (30° CA ). For example, in the case of a four-cylinder internal combustion engine in which the first and the fourth cylinders, and the second and the third cylinders are ignited at the same time, the teeth are provided at the intervals of 30° of crank angle (30° CA) between B35 (35° CA before top dead center cylinders and an immediately preceding signal, between B5 (5° CA before top dead center) of the second and the third cylinders and an immediately preceding signal, and between the immediately preceding signal and a signal preceding the immediately preceding signal.

The way for identifying cylinders using the signals is almost the same as the conventional art example shown in FIG. 4 through FIG. 8.

As shown in FIG. 10B, the microcomputer 10 controls the internal combustion engine so as to start operational processing such as ignition or fuel injection at a predetermined crank angle (e.g., B75 or B35).

The cylinder identification counter incorporated in the microcomputer 10 is set so as to increment its count in synchronization with the output signals or angle signals of the crank angle sensor 18. For instance, as shown in FIG. 10C, the cylinder identification counter increments its count for each 10° CA of crank angle, and it is reset when the crankshaft has rotated twice.

At a count value 33 on the cylinder identification counter that corresponds to the output signal (particular angle signal B35) of the crank angle sensor 18 indicative of the crank angle B35° CA in a normal condition (no noise), the microcomputer 10 calculates the ratio of a time interval between count values 29 and 30 corresponding to an interval or angle between the crank angles B75° CA and B65° CA to another time interval between the count values 30 and 33 corresponding to an interval or angle between the crank angles B65° CA and B35° CA. If the calculated ratio is approximately 1:3, that is, within a predetermined error range, then the microcomputer 10 decides that the output signal of the crank angle sensor 18 is normal, i.e., free of noise (see FIG. 10A); or if it is outside the predetermined error range, then the microcomputer 10 decides that the output signal is abnormal or includes a noise. More specifically, as illustrated in FIG. 11A, if a noise enters an output signal of the crank angle sensor 18, the cylinder identification counter is incremented by the noise, so that the foregoing ratio fails to fall within the predetermined error range or approximately 1:3. If the microcomputer 10 decides that an output signal of the crank angle sensor 18 is abnormal, then the cylinder identification is repeated.

In the example of the conventional art illustrated in FIG. 10 and FIG. 11, based on the count value on the cylinder identification counter, it has been determined whether or not an output signal of a crank angle sensor has been contaminated with noise according to the ratio of the cycle of the crank angle 10° CA between particular angle signals B75° CA and B65° CA to the cycle of the crank angle 30° CA between particular angle signals B65 and B35. In other words, the ratio of the cycles therebetween is 10:30=1:3, and it has been determined that a particular angle signal is free of noise if the cycle ratio stays around 1:3, while it has been determined that the signal involves noise if it substantially deviates from 1:3.

Thus, in this case, as shown in FIG. 11A and FIG. 11B, the operational processing such as ignition and fuel injection of the internal combustion engine is performed by the interrupts of the particular angle signals B75, B5 and B115. Therefore, in the past, if noise enters during the period between the previous cylinder crank angle B35° CA and the present cylinder crank angle B75° CA, the entry of noise is determined after the present cylinder crank angle B75° CA, so that by the time the noise is determined, the operational processing will have already been completed at the wrong previous cylinder crank angle B5° CA and the present cylinder crank angles B115° CA and B75° CA. Hence, even if the entry of noise is determined, the previous operational processing will have already been finished, failing to effectively inhibit erroneous operations caused by noise.

Further, the noise determination is effected also at the time of starting up an engine when a sudden change is anticipated in the rotational speed of the engine or the rotational speed of a crankshaft. Hence, there has been a possibility of an erroneous determination of noise due to a sudden change in the output signal cycle of a crank angle sensor.

SUMMARY OF THE INVENTION

Accordingly, the present invention has been made with a view toward solving the problem described above, and it is an object thereof to provide a cylinder identification apparatus for an internal combustion engine that is capable of inhibiting erroneous operations attributable to noise.

It is another object of the present invention to provide a cylinder identification apparatus for an internal combustion engine that is capable of inhibiting an increase in the time required for processing due to noise determination.

It is yet another object of the present invention to provide a cylinder identification apparatus for an internal combustion engine that is capable of inhibiting erroneous noise determination caused by a change in the cycle of a normal crank angle signal.

It is a further object of the present invention to provide a cylinder identification apparatus for an internal combustion engine that is capable of inhibiting erroneous noise determination caused by a sudden change in the cycle of a crank angle signal.

According to an aspect of the present invention, there is provided a cylinder identification apparatus for an internal combustion engine comprising a crank angle sensor for detecting a rotational position of a crankshaft of the internal combustion engine having a plurality of cylinders, cylinder identifying means for identifying the respective cylinders based on a signal output from the crank angle sensor, engine controlling means for controlling the internal combustion engine based on the result of cylinder identification carried out by the cylinder identifying means, and noise determining means for determining, before operational processing is implemented based on a particular angle signal, whether the particular angle signal among output signals from the crank angle sensor includes noise, so that it inhibits subsequent operational processing if there is noise included in the particular angle signal.

In a preferred form of the invention, when the noise determining means receives a present particular angle signal, it effects noise determination on all angle signals from the last particular angle signal to the present particular angle signal at the same time.

In another preferred form of the invention, the noise determining means compares the present angle signal cycle with the last normal angle signal cycle whenever it effects noise determination.

In a further preferred form of the invention, the cylinder identification apparatus further comprises noise determination inhibiting means for inhibiting the noise determination of the noise determining means at the time of engine starting in which a sudden change in an output signal of the crank angle sensor is anticipated.

The above and other objects, features and advantages of the present invention will become more readily apparent to those skilled in the art from the following detailed description of a presently preferred embodiment of the invention taken in conjunction with the accompanying drawings.

DESCRIPTION OF THE PREFERRED EMBODIMENT

An embodiment of the present invention will be described in conjunction with the accompanying drawings.

Figure 1A:
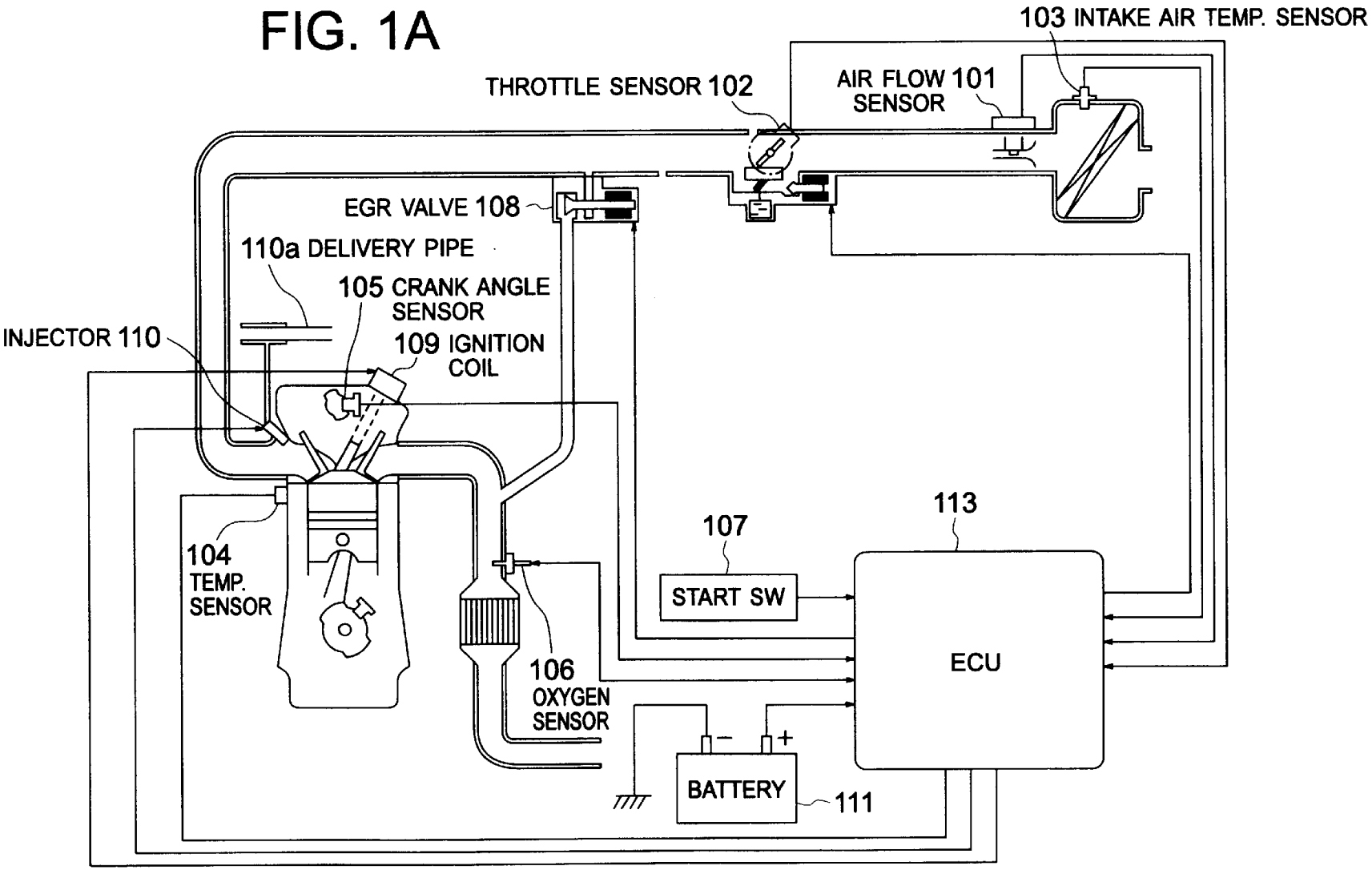
FIG. 1A is a schematic diagram illustrating the configuration of an internal combustion engine equipped with a cylinder identification apparatus in accordance with the present invention.

FIG. 1A schematically illustrates the configuration of an internal combustion engine equipped with a cylinder identification apparatus in accordance with the present invention. The internal combustion engine shown in FIG. 1A includes an flow sensor 101 provided in an intake pipe of the internal combustion engine to measure the quantity of air introduced into the engine, a throttle sensor 102 for detecting the opening of a throttle valve provided in the intake pipe, an intake air temperature sensor 103 installed to an air cleaner at a distal end of the intake pipe to detect the temperature of intake air, a temperature sensor 104 mounted on the main body of the engine to detect the temperature of engine coolant or cooling water, a crank angle sensor 105 that detects the rotational angle of a crankshaft by detecting the revolution of a camshaft or the like that rotates in synchronization with the crankshaft of the engine, an oxygen sensor 106 that measures the flow of oxygen in an exhaust pipe to thereby detect a combustion state, and a start switch 107 provided in a driver's cabin of a vehicle (not shown). The internal combustion engine further includes an exhaust gas recirculation (EGR) valve 108 that recirculates a part of exhaust gas into the intake pipe according to the operating condition of the engine, an ignition coil 109 for causing a spark plug (not shown) to generate a spark ignition to fire an air-fuel mixture in a combustion chamber in the main body of the engine, an injector 110 that is connected to a fuel tank (not shown) via a delivery pipe 110*a* and installed to the intake pipe such that its distal end is presented into the intake pipe so as to inject fuel into the intake pipe, a battery 111 for supplying electric power to a variety of devices of the vehicle, and an electronic control unit 113 that receives output signals from various sensors, the start switch 7, etc., to control the exhaust gas recirculation valve 108, the ignition coil 109, the injector 110, etc., to thereby control the engine. The electronic control unit 113 controls the engine by executing a control program stored therein. The electronic control unit 113 detects a battery voltage by the voltage applied by the battery 111.

Figure 1B:
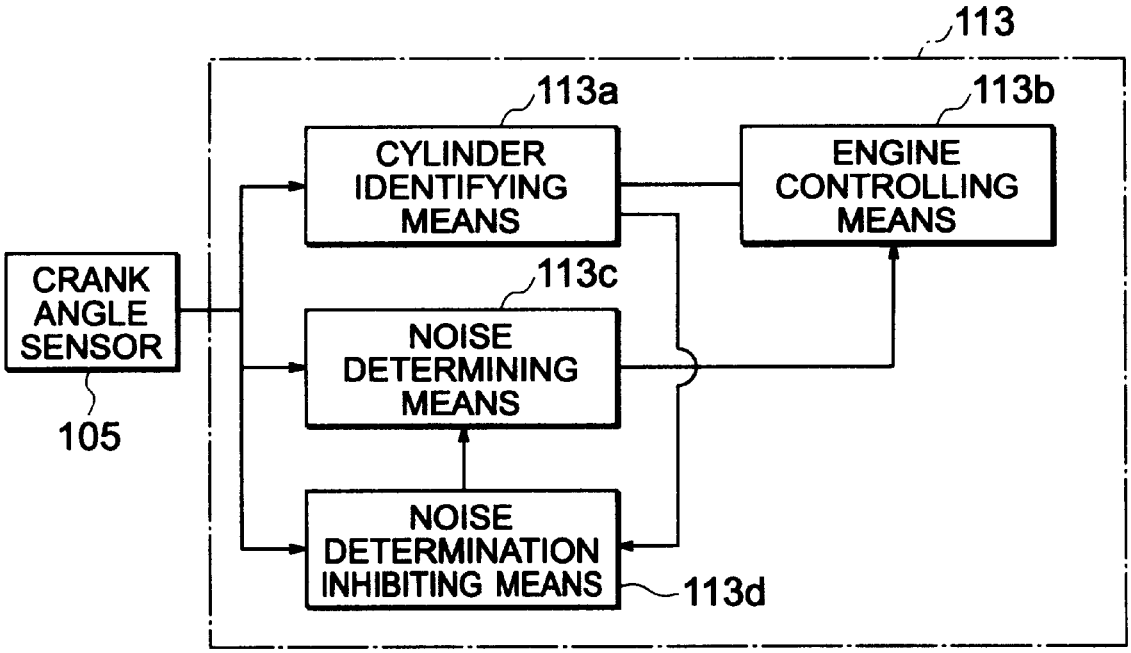
FIG. 1B is a functional block diagram of an electronic control unit of the apparatus.

FIG. 1B is a functional block diagram of the electronic control unit 113. As shown in FIG. 1B, the electronic control unit 113 is equipped with a cylinder identifying means in the form of a cylinder identifier 113*a* for identifying a cylinder based on a signal output from the crank angle sensor 105, an engine controlling means in the form of an engine controller 113*b* for controlling the internal combustion engine including an ignition system and a fuel injection system according to the cylinder identification result, and a noise determining means in the form of a noise determiner 113*c* that determines whether or not a particular angle signal among the output signals from the crank angle sensor 105 includes noise, before ignition control, fuel injection control, or other type of operational processing is implemented based on the foregoing particular angle signal, and that inhibits subsequent operational processing if noise has been detected.

Figure 8:
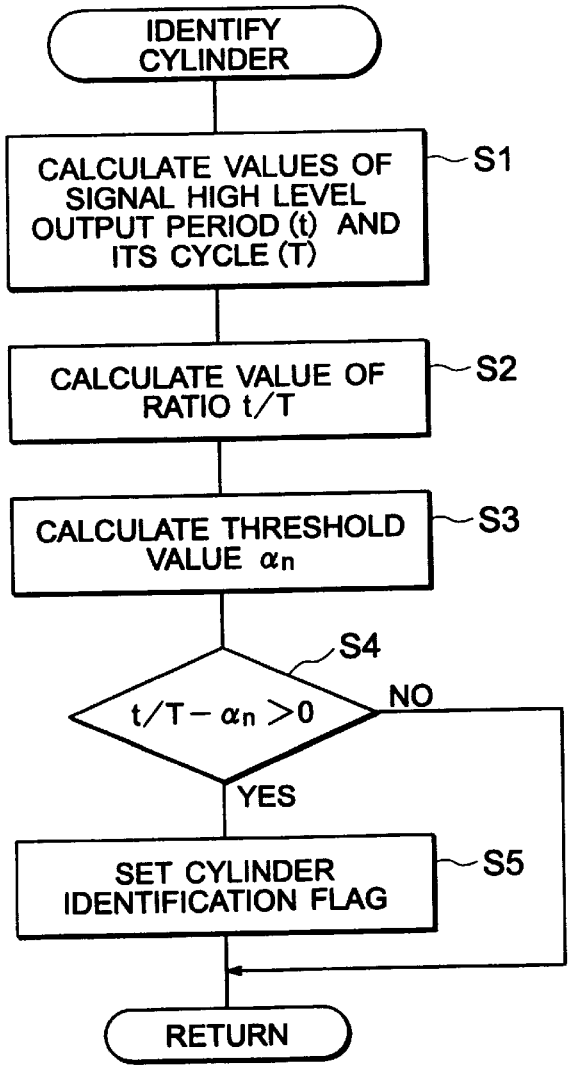
FIG. 8 PRIOR ART
FIG. 8 is a flowchart illustrative of a conventional cylinder identification routine.
Figure 9:
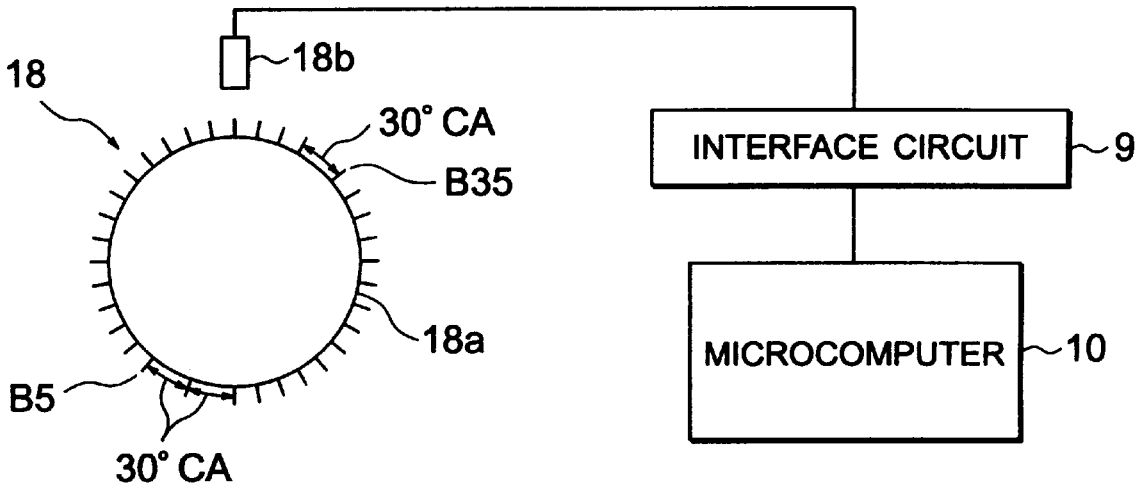
PRIOR ART FIG. 9
FIG. 9 is a schematic block diagram of another conventional cylinder identification apparatus for an internal combustion engine.
Figure 10A:
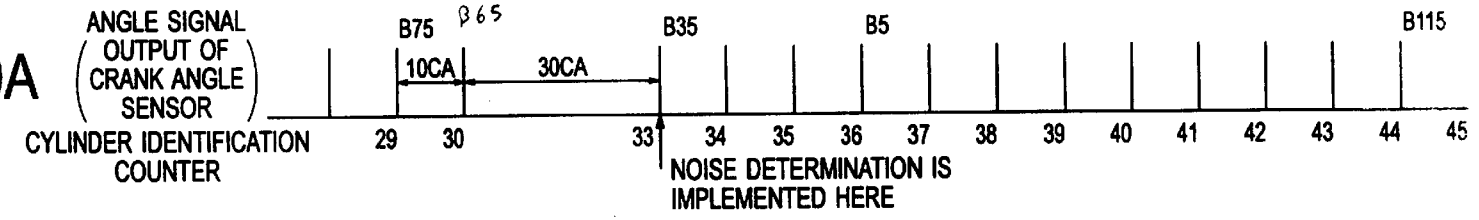
PRIOR ART FIG. 10A
FIG. 10A is a diagram showing the output signals of a crank angle sensor and the count values on a cylinder identification counter in a normal condition of the second-mentioned example of the conventional art.
Figure 10B:
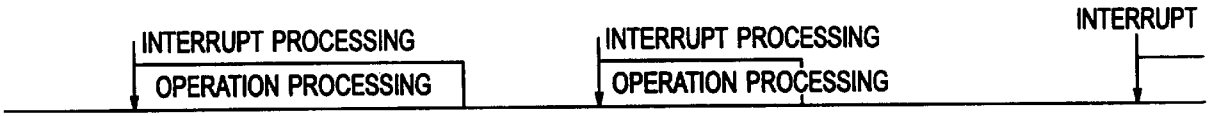
PRIOR ART FIG. 10B
FIG. 10B is a diagram showing the timing of interrupt processing (operational processing) based on particular angle signals in the normal condition.
Figure 10C:
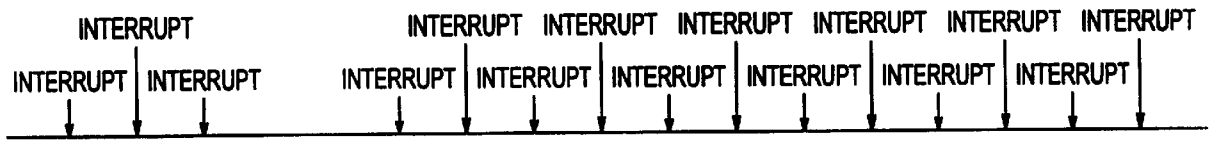
PRIOR ART FIG. 10C
FIG. 10C is a diagram showing the interrupt timing controlled by a timer interrupts in synchronization with crank angle signals.
Figures 11A, 11B, 11C:
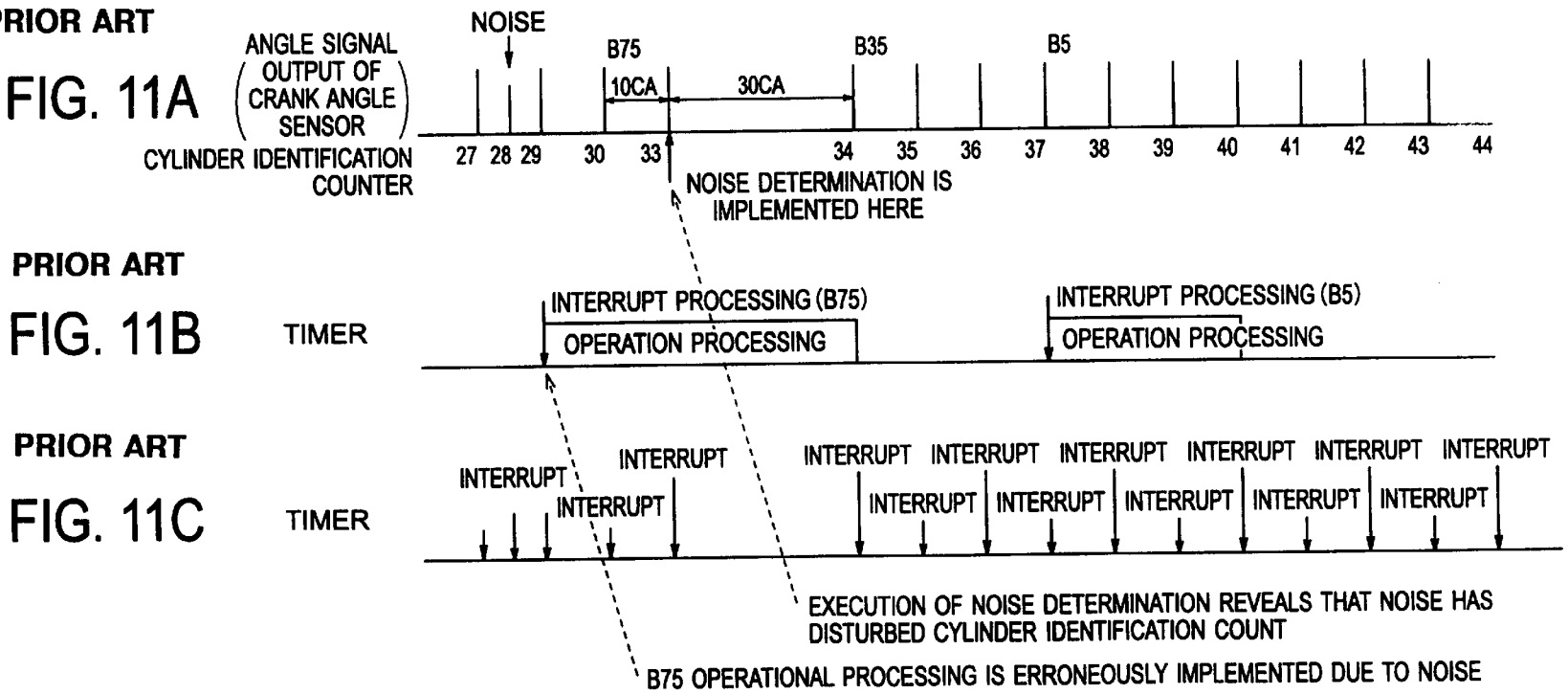
FIG. 11A PRIOR ART
FIG. 11B PRIOR ART
FIG. 11A is a diagram showing the output signals of a crank angle sensor and the count values on a cylinder identification counter in an abnormal condition (i.e., in the presence of noise) of the second-mentioned example of the conventional art.
FIG. 11B is a diagram showing the timing of interrupt processing (operational processing) based on particular angle signals in the abnormal condition.
FIG. 11C is a diagram showing the interrupt timing controlled by a timer interrupts in synchronization with crank angle signals in the abnormal condition.

The cylinder identifying means 113*a* may carry out cylinder identification either according to the flowchart illustrative of the example of the conventional cylinder identification procedure shown in FIG. 8 as discussed above, or according to another popular principle known to those skilled in the art.

When the noise determining means 113*c* receives a present particular angle signal, it effects the noise determination on all angle signals from a preceding particular angle signal to the present particular angle signal at the same time. When carrying out the noise determination, the noise determining means 113*c* always compares the present angle signal cycle with the last or previous normal angle signal cycle or a reference signal cycle.

In The electronic control unit 113 is further equipped with a noise determination inhibiting means in the form of a noise determination inhibitor 113 that inhibits the noise determination effected by the noise determining means 113*c* at the time of starting an engine wherein a sudden change is anticipated in an output signal of the crank angle sensor 105. The noise determination inhibiting means 113*d* decides that the engine is started when the engine speed obtained based on an output signal of the crank angle sensor is a predetermined value (e.g. 500 rpm) or less or before cylinder identification is completed.

The electronic control unit 113 implements fuel control and ignition control by controlling the injector 110 and the ignition coil 109 in accordance with the value on the cylinder identification counter and a cylinder determination state.

Figures 2A, 2B, 2C, 2D:
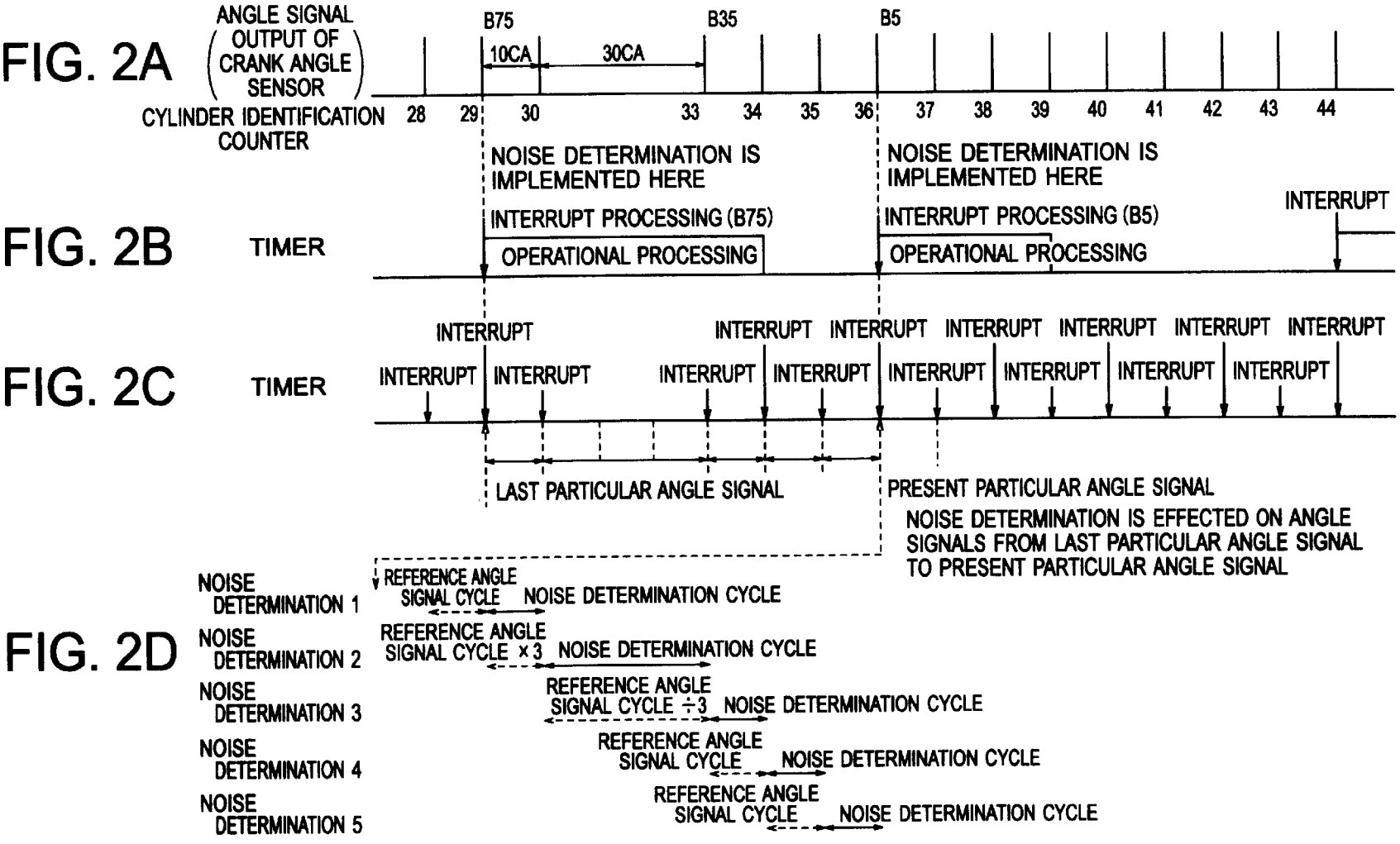
FIG. 2A is a diagram showing the output signals of a crank angle sensor and the count values on a cylinder identification counter.
FIG. 2B is a diagram showing the timing of interrupt processing (operational processing) controlled by a timer according to particular angle signals.
FIG. 2C is a diagram slowing the interrupt timing controlled by the timer interrupts in synchronization with crank angle signals, and the signal cycles of the crank angle signals for performing noise determination.
FIG. 2D is a schematic representation illustrating specific examples of the noise determination, in which reference angle signal cycles are shown in contrast to noise determination cycles.

FIGS. 2A through 2D illustrate the operation of the cylinder identification apparatus for an internal combustion engine in accordance with the present invention, wherein FIG. 2A is a diagram showing the output timing of crank angle signals and the count values on a cylinder identification counter; FIG. 2B is a diagram showing operational processing based on the interrupts of a timer; FIG. 2C is a diagram showing the interrupt timing controlled by the timer interrupts in synchronization with crank angle signals, and the signal cycles of the crank angle signals for performing noise determination; and FIG. 2D is a schematic representation illustrating specific examples of the noise determination, in which reference angle signal cycles are shown in contrast to noise determination cycles.

Figure 3:
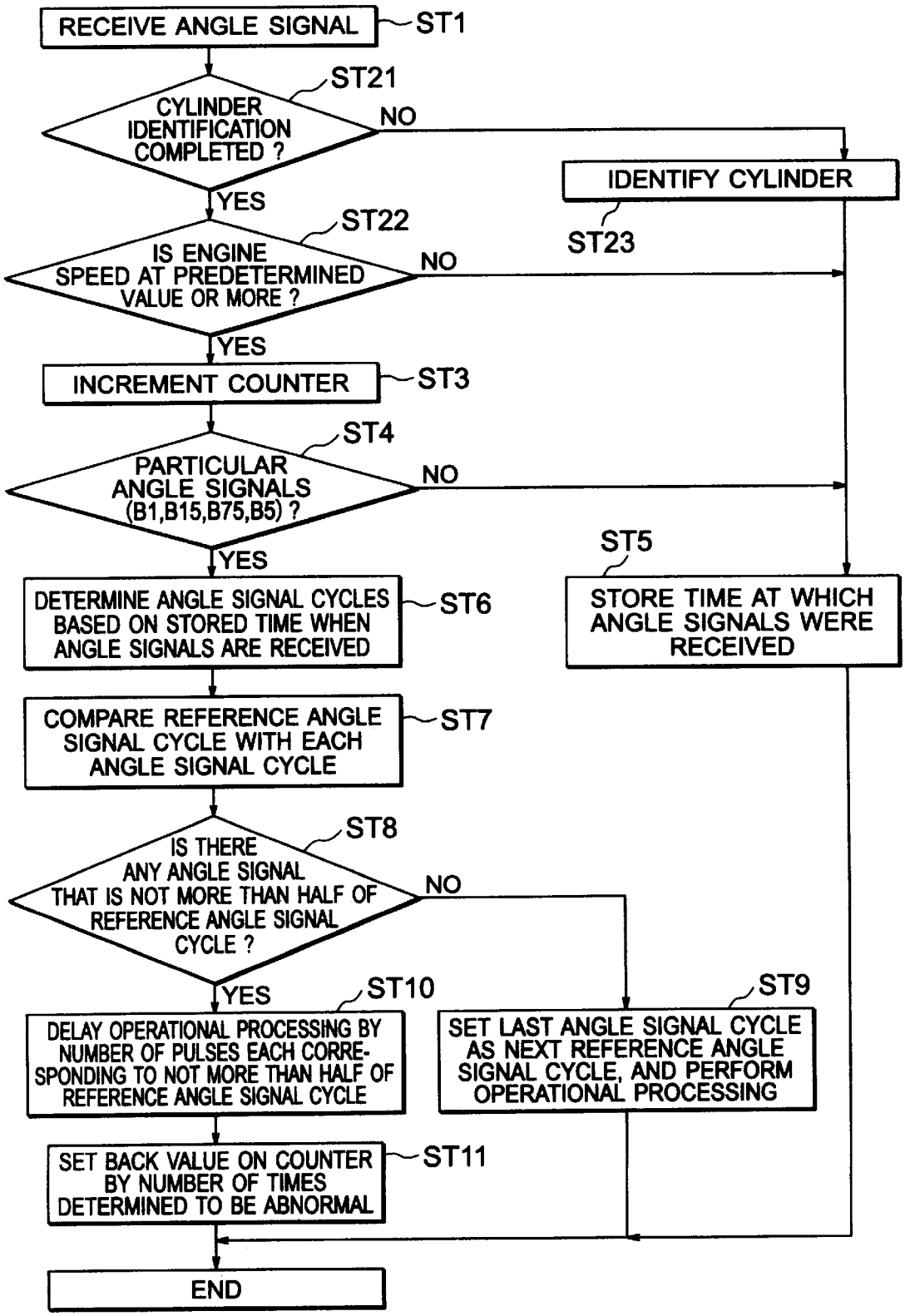
FIG. 3 is a flowchart illustrative of the operation of a cylinder identification apparatus in accordance with the present invention.
Figure 4:
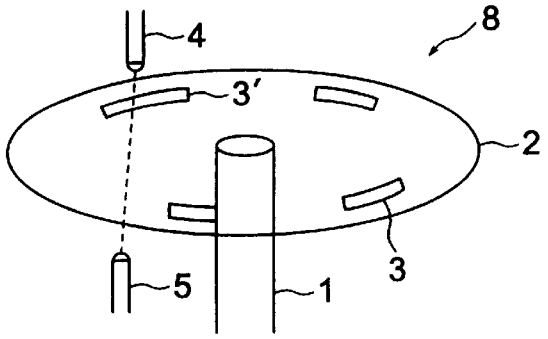
PRIOR ART FIG. 4
FIG. 4 is a diagram showing the structure of a conventional revolution signal generator.
Figure 5:
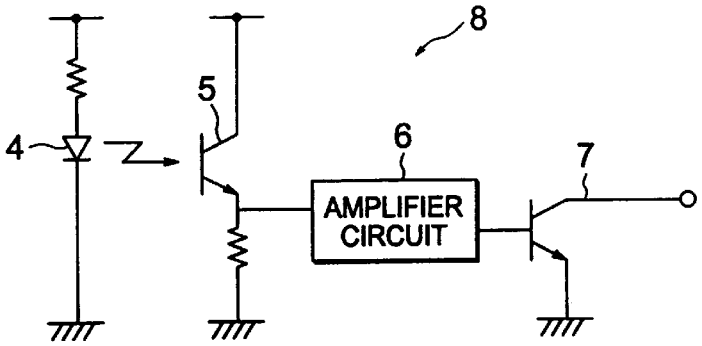
FIG. 5 PRIOR ART
FIG. 5 is a signal processing circuit diagram of the conventional revolution signal generator.
Figure 6:
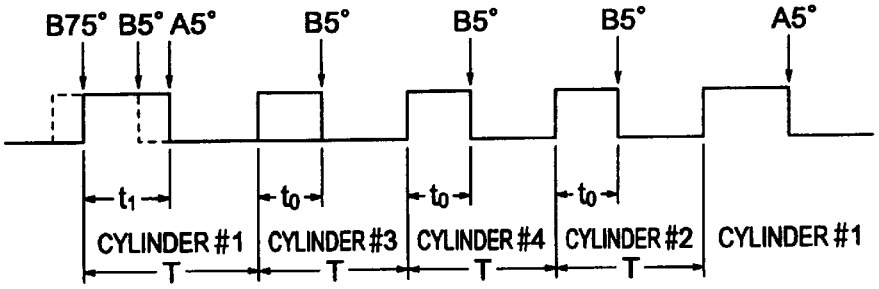
FIG. 6 PRIOR ART
FIG. 6 is a signal waveform diagram of the conventional revolution signal generator.
Figure 7:
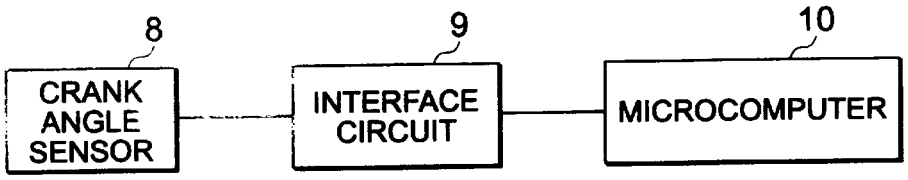
PRIOR ART FIG. 7
FIG. 7 is a schematic block diagram of a conventional cylinder identification apparatus for an internal combustion engine.

FIG. 3 is a flowchart illustrative of the operation of the cylinder identification apparatus for an internal combustion engine in accordance with the present invention.

Referring to FIGS. 2A through 2D and FIG. 3, a description will be given of the noise determination effected by the cylinder identification apparatus in accordance with the present invention.

First, as shown in FIG. 3, in step ST1, when an output signal or angle signal of the crank angle sensor is input to the engine control unit 113, it is determined whether the engine is being started based primarily on the engine speed obtained from the output signal of the crank angle sensor 105. More specifically, in step ST21, it is determined whether cylinder identification has been completed. If the determination result is YES, then it is further determined in step ST22 whether the engine speed is a predetermined value (e.g., 500 rpm) or more. If the determination result in step ST22 is YES, then the sequence advances to step ST3. If the determination result is NO in step ST21, it is then decided that the engine is being started, and cylinder identification is effected in step ST23, and the time when an angle signal was received is stored in a memory in step ST5, thus terminating the processing. If the determination result in step ST22 is NO, the flow proceeds to step ST5 and terminates the processing.

If the determination results in ST21 and ST22 are YES, then it is decided that the engine is out of or other than the start-up period, and hence the cylinder identification counter is incremented in step ST3. Subsequently, it is determined in step ST4 whether a received angle signal is a particular angle signal (e.g., B115, B75, or B5) indicative of a particular crank angle. If the determination result is NO, then the flow advances to step ST5 and terminates the processing.

If the determination result in step ST4 is YES, then the cycles of the angle signals are determined based on the time that was stored in the memory upon receipt of the angle signal in step ST6, and the thus obtained angle signal cycles are compared with reference angle signal cycles (the signal cycles in a noise determination period) in step ST7. If the present angle signal is the particular angle signal, then the reference angle signal cycle at the start of the processing lies between a particular angle signal B75 and its immediately following angle signal. As will be discussed later, however, the reference angle signal cycle is updated sequentially. As illustrated in FIG. 2D, in order to implement the comparison, the reference angle signal cycle is adjusted so that it is equal to the noise determination cycle before calculating the ratio of these two cycles.

Subsequently, it is determined in step ST8 whether any of the angle signal cycles is not more than half the reference angle signal cycle. If the determination result is NO, then the flow advances to step ST9 wherein it sets the last one angle signal cycle as the next reference angle signal cycle, and carries out the processing operation for the engine control such as the ignition control or fuel injection control before it terminates the noise determination processing.

If the determination result in step ST8 is YES, then the start of the operational processing such as the engine control operation is delayed by the number of pulses each corresponding to not more than half the reference angle signal cycle (step ST10), and the count value on the cylinder identification counter is set back by the value corresponding to the number of times that has been determined abnormal (step ST11), and the processing is terminated.

As apparent from the foregoing, the present invention provides the following outstanding advantages.

The cylinder identification apparatus for an internal combustion engine in accordance with the present invention comprises a crank angle sensor for detecting a rotational position of a crankshaft of the internal combustion engine having a plurality of cylinders; cylinder identifying means for identifying the respective cylinders based on a signal output from the crank angle sensor; engine controlling means for controlling the internal combustion engine based on the result of cylinder identification carried out by the cylinder identifying means; and noise determining means for determining, before operational processing is implemented based on a particular angle signal, whether the particular angle signal among output signals from the crank angle sensor includes noise, so that it inhibits subsequent operational processing if there is noise included in the particular angle signal. With this arrangement, the apparatus is capable of inhibiting erroneous operational processing such as erroneous fuel injection of an injector or erroneous ignition of a spark plug.

Further, when the noise determining means receives a present particular angle signal, it effects the noise determination on all angle signals from the last or previous particular angle signal to the present particular angle signal at the same time. Hence, in comparison with a case wherein the noise determination is effected each time an angle signal is received, the time required for carrying out the noise determination can be reduced, thus making it possible to permit smooth noise determination processing even when the engine is running at high speed.

Moreover, the noise determining means compares the present angle signal cycle with the last or previous normal angle signal cycle whenever it effects the noise determination. Therefore, noise determination errors can be inhibited even in such a case wherein the cycle of the angle signals issued from a crank angle sensor vary during an intake stroke, a compression stroke, a combustion and expansion stroke, or an exhaust stroke, or during acceleration or deceleration of the engine.

In addition, at the time of starting an engine when the engine speed tends to considerably vary and a sudden change in the signals output from the crank angle sensor is anticipated, the noise determination by the noise determining means is inhibited by the noise determination inhibiting means. This makes it possible to avoid erroneous noise determination upon starting up of the engine.

What is claimed is:

1. A cylinder identification apparatus for an internal combustion engine, comprising:

a crank angle sensor for detecting a rotational position of a crankshaft of the internal combustion engine having a plurality of cylinders in generating a series of angle signals;

cylinder identifying means for identifying each of the plurality of cylinders based on a signal output from the crank angle sensor;

engine controlling means for controlling the internal combustion engine based on the result of cylinder identification carried out by the cylinder identifying means; and noise determining means for determining, before operational processing is implemented based on a particular angle signal, whether the particular angle signal among output signals from the crank angle sensor includes noise, so that the noise determining means inhibits subsequent operational processing if there is noise included in the particular angle signal, wherein when the noise determining means receives a present particular angle signal, it effects noise determination on all of a series of angle signals from a last said particular angle signal to the present said particular angle signal at the same time.

2. The cylinder identification apparatus for an internal combustion engine according to claim 1, further comprising noise determination inhibiting means for inhibiting noise determination of the noise determining means at the time of engine starting in which a sudden change in an output signal of the crank angle sensor is anticipated.

3. The cylinder identification apparatus for an internal combustion engine according to claim 1, wherein said noise determining means delays, when determining a presence of noise, subsequent operational processing by a number of noise pulses detected.

4. A cylinder identification apparatus for an internal combustion engine, comprising:

a crank angle sensor for detecting a rotational position of a crankshaft of the internal combustion engine having a plurality of cylinders in generating a series of angle signals in predetermined cycles;

cylinder identifying means for identifying each of the plurality of cylinders based on a signal output from the crank angle sensor;

engine controlling means for controlling the internal combustion engine based on the result of cylinder identification carried out by the cylinder identifying means; and noise determining means for determining, before operational processing is implemented based on a particular angle signal, whether the particular angle signal among output signals from the crank angle sensor includes noise, so that the noise determining means inhibits subsequent operational processing if there is noise included in the particular angle signal, wherein the noise determining means compares an angle signal generation of each present angle signal cycle with that of a last normal angle signal cycle whenever it effects noise determination.

5. The cylinder identification apparatus for an internal combustion engine according to claim 4, further comprising noise determination inhibiting means for inhibiting noise determination of the noise determining means at the time of engine starting in which a sudden change in an output signal of the crank angle sensor is anticipated.

* * * * *